US011135483B2

(12) United States Patent
Brady

(10) Patent No.: US 11,135,483 B2
(45) Date of Patent: Oct. 5, 2021

(54) DEVICE FOR COLLECTING AND STORING PLAYING OBJECTS

(71) Applicant: Daniel George Joseph Brady, Ottawa (CA)

(72) Inventor: Daniel George Joseph Brady, Ottawa (CA)

( * ) Notice: Subject to any disclaimer, the term of this patent is extended or adjusted under 35 U.S.C. 154(b) by 0 days.

(21) Appl. No.: 16/318,722

(22) PCT Filed: Jul. 14, 2017

(86) PCT No.: PCT/CA2017/050853
§ 371 (c)(1),
(2) Date: Jan. 18, 2019

(87) PCT Pub. No.: WO2018/014119
PCT Pub. Date: Jan. 25, 2018

(65) Prior Publication Data

US 2019/0240542 A1 Aug. 8, 2019

(30) Foreign Application Priority Data

Jul. 19, 2016 (CA) ..... CA 2936542

(51) Int. Cl.
*A63B 47/02* (2006.01)
*A63B 59/70* (2015.01)
(Continued)

(52) U.S. Cl.
CPC ..... *A63B 47/02* (2013.01); *A63B 59/70* (2015.10); *A63B 60/34* (2015.10); *A63B 67/14* (2013.01);
(Continued)

(58) Field of Classification Search
CPC ..... A63B 47/02; A63B 71/0045; A63B 67/14; A63B 71/0036; A63B 60/34; A63B 59/70;
(Continued)

(56) References Cited

U.S. PATENT DOCUMENTS 1,877,820 A 9/1930 Costello
3,663,049 A 5/1972 James
(Continued)

FOREIGN PATENT DOCUMENTS

CA 2373696 8/2002
CA 2388124 12/2003
(Continued)

OTHER PUBLICATIONS

"'Pucker-up' picks a pack of hockey pucks" by Carole Vyhnak. The Star, Sep. 9, 2010, 4 pages. Apr. 4, 2019. https://www.thestarcom/news/gta/2010/09/09/puckerup_picks_a_pack_of hockey_pucks.htrni.
(Continued)

*Primary Examiner* — Jeffrey S Vanderveen

(57) ABSTRACT

A device for collecting and storing playing objects is disclosed. The device comprises a handle portion for detachably connecting to a handle. The device also comprises a frame portion comprising an opening for receiving playing objects, a collecting side, a storing side, and a net attached to the frame portion and extending outwardly from the storing side of the frame portion.

15 Claims, 4 Drawing Sheets

(51) Int. Cl.

| | |
|---|---|
| ***A63B 67/14*** | (2006.01) |
| ***A63B 71/00*** | (2006.01) |
| ***A63B 60/34*** | (2015.01) |
| ***A63B 69/00*** | (2006.01) |
| ***A63B 69/36*** | (2006.01) |
| ***A63B 69/38*** | (2006.01) |
| ***A63B 60/06*** | (2015.01) |
| ***A63B 60/28*** | (2015.01) |
| ***E01H 1/12*** | (2006.01) |

(52) U.S. Cl.
CPC ..... *A63B 71/0036* (2013.01); *A63B 71/0045* (2013.01); *E01H 1/12* (2013.01); *A63B 60/06* (2015.10); *A63B 60/28* (2015.10); *A63B 69/0026* (2013.01); *A63B 69/36* (2013.01); *A63B 69/38* (2013.01); *A63B 2209/10* (2013.01); *A63B 2210/50* (2013.01); *A63B 2225/093* (2013.01)

(58) Field of Classification Search
CPC . A63B 2210/50; A63B 2209/10; A63B 60/28; A63B 60/06; A63B 2225/093; A63B 69/38; A63B 69/36; A63B 69/0026; E01H 1/12
See application file for complete search history.

(56) References Cited

U.S. PATENT DOCUMENTS

| | | | | | |
|---|---|---|---|---|---|
| 5,040,754 | A * | 8/1991 | Dearman | B62B 1/147 | 248/97 |
| 5,513,884 | A * | 5/1996 | Bucher | A63B 47/02 | 294/19.2 |
| D393,300 | S | 4/1998 | Andrews et al. | | |
| 7,066,847 | B2 * | 6/2006 | Power | A63B 47/02 | 473/446 |
| 2006/0116224 | A1 | 6/2006 | Andersen | | |
| 2006/0252581 | A1 * | 11/2006 | Wegryn | A63B 47/02 | 473/446 |
| 2007/0259742 | A1 * | 11/2007 | McCauley, Jr. | A63B 59/30 | 473/513 |
| 2011/0042978 | A1 * | 2/2011 | Elhadary | E01H 1/12 | 294/1.3 |
| 2014/0121040 | A1 * | 5/2014 | Cappello | A63B 69/00 | 473/432 |

FOREIGN PATENT DOCUMENTS

| | | |
|---|---|---|
| CA | 2488919 | 6/2005 |
| CA | 2507347 | 6/2006 |
| JP | 2001135601 | 2/2001 |
| JP | 20020325865 | 11/2002 |
| JP | 2006116263 A | 5/2006 |
| JP | 2008253405 A | 10/2008 |
| WO | 9737729 | 10/1997 |

OTHER PUBLICATIONS

Winnwell USA Hockey Puck Catcher Holder Transporter PC0100. 4 pages. Apr. 4, 2019. https://www.amazon.ca/Winnwell-Hockey-Catcher-Holder-Transporter/dp/B0093U9N4W.

PCT Written Opinion of the International Searching Authority. dated Dec. 6, 2017, International Application No. PCT/CA2017/050853. Applicant: Brady, Daniel George Joseph. pp. 1-7.

PCT International Search Report. dated Dec. 6, 2017, International Application No. PCT/CA2017/050853. Applicant: Brady, Daniel George Joseph. pp. 1-4.

* cited by examiner

DEVICE FOR COLLECTING AND STORING PLAYING OBJECTS

CROSS-REFERENCE TO RELATED APPLICATIONS

This application is a national stage application under 35 U.S.C. § 371 of PCT Application No. PCT/CA2017/050853, filed Jul. 14, 2017, which claims priority to and the benefit of Canadian Application No. 2,936,542 filed on Jul. 19, 2016, both of which applications are incorporated herein by reference in their entirety.

TECHNICAL FIELD

The present invention relates to devices for collecting and storing playing objects.

BACKGROUND

Many sports and recreational games are played with various types of playing objects, such as hockey pucks, tennis balls, golf balls, field hockey balls, ringette rings, and the like. During a practice or pre-game warm-up, multiple playing objects may be scattered on the playing surface or field for use by the individuals playing the sport or recreational game. At the end of an exercise during the practice or pre-game warm-up, the playing objects may be collected and placed into a storage device or container for later use. Similarly, at the end of the practice or pre-game warm-up, the playing objects may be collected and stored for future use.

Collecting and storing the many playing objects is often an inefficient process. For example, at the end of an exercise during a practice or a pre-game warm-up, one or several individuals may shoot or direct the playing objects into or towards one common area, and then kneel down on the playing surface or bend over to collect the playing objects by hand. The playing objects may then be placed in a storing device for future use. This process is often time consuming.

Some collection devices for certain specific sports or recreational games currently exist; however, these devices have various limitations.

U.S. Pat. No. 7,066,847 to Dale Power titled the "Puck Catcher" ("U.S. 847 Patent") discloses a device for collecting and storing pucks and balls. The device comprises two U-shaped members (1, 2) connected by various members (3, 4, 5, 6), a flexible mesh (17) covering the device, and a ramp (12). As can be seen from FIG. 1 of the U.S. 847 Patent, the device is bulky with various rigid members. Accordingly, the device takes up significant storage space or volume, even when the mesh area is empty. For example, the device disclosed in the U.S. 847 Patent may not fit into certain a hockey players' hockey bags together with the players' hockey equipment.

In addition, the multiple members of the device disclosed in the U.S. 847 Patent must be manufactured individually and then subsequently assembled. This may result in greater manufacturing and assembly time and costs.

Further, the device disclosed in the U.S. 847 Patent does not have a handle for use when collecting playing objects. Instead, playing objects are shot or directed into the device via the ramp, and then the device is picked-up by the handle (11). However, if the device is made of lightweight material, then the device may not stay in place as playing objects are shot into the device. On the other hand, if the device is made of a heavier material to prevent movement while playing objects are shot into the device, then the device may be more difficult or less convenient to carry. A further disadvantage is that the device stays in one place while playing objects are collected in it. This means that players must less conveniently go around to each of the individual playing objects and bring them to the device, and successfully shoot the objects into the device.

Another device known in the prior art for collecting and storing hockey pucks is the Pucker Up, which is the subject of Canadian Patent No. 2,644,209 to William IRA Wright and titled "Puck Retriever" ("209 Patent"). The Pucker Up comprises a tube (12), an opening at a lower end (16) having a circular inlet (30), surrounded by a resiliently deformable ring (34, 60). In operation, the circular inlet (30) is placed over a puck to be collected and stored, and the user pushes the device down on the puck. This motion causes the ring (34, 60) to deform such that the puck is pressed into the tube (12). Once the puck passes the ring (34, 60), the ring (34, 60) prevents the puck from falling back through the circular inlet (30). This motion is repeated until all the pucks are collected or the tube (12) is full.

With the Pucker Up, each puck must be precisely picked-up individually, and therefore it may be time-consuming to collect many pucks. Further, since the pucks are stacked on top of each other, the tube (12) must be sufficiently long to hold a plurality of pucks. As a result, the tube (12), if too long, may be inefficient or uncomfortable when fully or almost fully loaded. On the other hand, the tube (12), if too short, may not provide sufficient capacity for all pucks in use.

Also, the skilled person would understand that in order to use the Pucker Up to collect and store playing objects of other sports or recreational games other than hockey pucks, the dimensions of the device would need to be changed. For example, the dimensions of the ring (34, 60) may prevent a puck from falling back through the circular inlet 30, but the ring, unless modified, is unlikely to prevent a golf ball from falling through. Therefore, the Pucker Up cannot be used for collecting and storing both hockey pucks and golf balls (or other playing objects that are not the same size as hockey pucks).

The prior art also includes collecting and storing devices in the field of golf. For example, U.S. Pat. No. 3,663,049 to Clifford Neil James ("U.S. 049 Patent") discloses a "Golf Ball Retrieval and Storage Device" comprising an elongated handle (3), a rigid loop (4), a bag (5) mounted to the rigid loop that has an enlarged storage portion (6) and an open mouth (7). The rigid loop (4) has a relatively straight portion (9) in the range of between two and four times the diameter of a golf ball (approximately 1.68 inches or 4.27 cm in diameter). The bag (5) has a restricted neck (11) with a diameter of more than one but less than two golf balls. The restricted neck (11) allows a golf ball to pass into the enlarged storage portion (6) without restriction. The handle (3) is also detachable from the loop (4).

As is clear from the U.S. 049 Patent, the device is directed solely at collecting and retrieving golf balls. The device may not be useable or convenient for collecting other playing objects, such as hockey pucks (diameter of 3 inches or 7.6 cm) and tennis balls (diameter of 2.7 inches or 6.86 cm), because these playing objects may not fit through the restricted neck (11), or they may fit but only barely (which may make for more challenging collection of objects).

In addition, the device disclosed in the U.S. 049 Patent discloses a self-supporting rigid loop (4) that is directly connected to a handle (3). While the limited supporting structure joining the rigid loop (4) with the handle (3) may be acceptable for collecting and storing golf balls (e.g., United States Golf Association requires golf balls to weigh less than 45.93 g), the rigid loop (4) may not be strong enough to support or withstand heavier playing objects, such as hockey pucks (approximately 156 g-170 g), which may be shot at the device at significant speeds. Furthermore, vertically (or near-vertically) connecting the handle (3) to the rigid loop (4) on top of the middle of the loop may be less convenient or flexible for a user, as the user, in order to keep the rigid loop (4) level with the playing surface, generally needs hold the device directly next to himself or herself. This limits the user's ability to extend the device or reach for objects with the device. In other words, the range of motion or use of the device is more restrictive and less convenient.

U.S. Pat. No. 5,513,884 to Betty A. Bucher titled "Golf Ball Retrieving Device" ("U.S. 884 Patent") discloses another device for collecting and storing golf balls. The device comprises a handle means (12) and a basket frame (14) for supporting a flexible mesh basket (16).

Similar to the U.S. 049 Patent, the device disclosed in the U.S. 884 Patent may have certain deficiencies outside of the field of golf. For example, there is no reinforcing structure for the connection between the basket frame (14) and the tube (36). Therefore, the device may not be strong enough to support or withstand heavier playing objects, such as hockey pucks.

Accordingly, an alternative and/or improved device for collecting and storing a variety of playing objects is desired.

BRIEF DESCRIPTION OF THE DRAWINGS

Features, aspects and advantages of the present disclosure will become understood from the following detailed description, taken in combination with the appended drawings, in which.

DETAILED DESCRIPTION

Figure 1:
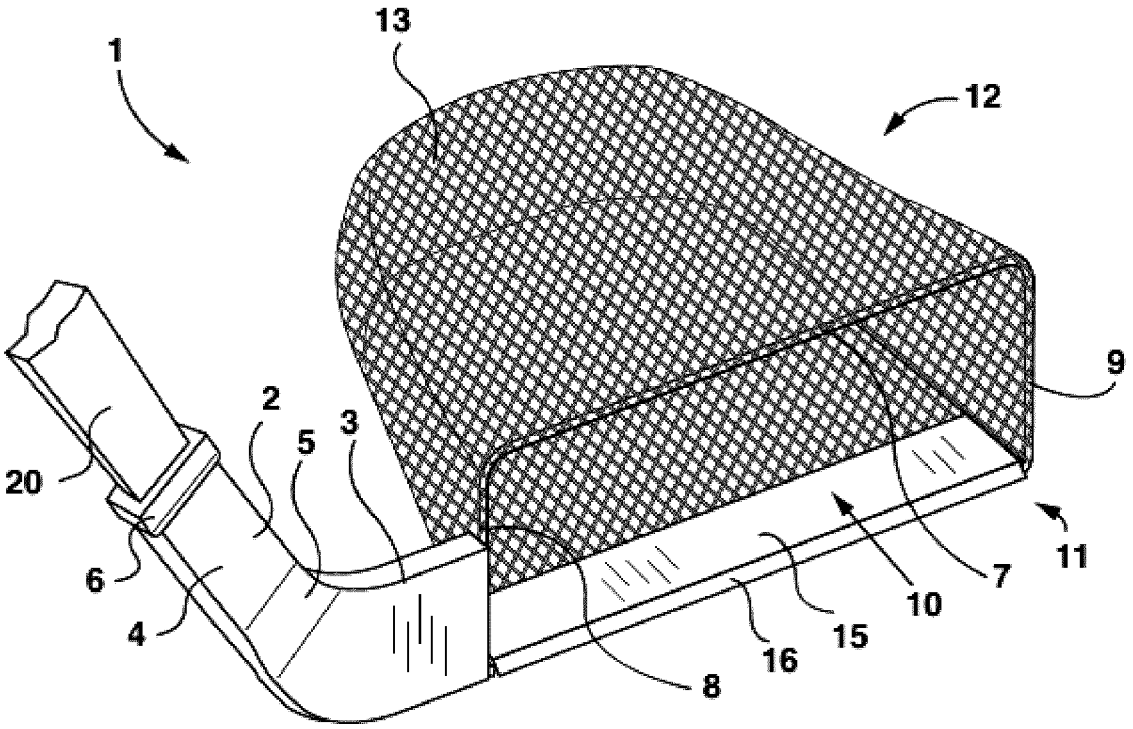
FIG. 1 is a perspective view from the top of a device in accordance with the present invention.

In accordance with the present disclosure there is provided a device for collecting and storing playing objects, the device comprising: a handle portion for detachably connecting to a handle, the handle portion comprising: a base portion; and a connector portion, the connector portion comprising a base end and a connector end, wherein: the base end is adjacent to the base portion; the connector portion extends at least partially upwards and ends at the connector end; and the handle is connectable to the handle portion at the connector end; a frame portion comprising a first end and a second end, wherein the first end is adjacent to the base portion and the frame portion extends from the first end to the second end, the frame portion further comprising: an opening for receiving playing objects; a collecting side; a storing side; and a net attached to the frame portion and extending outwardly from the storing side of the frame portion.

In a further embodiment, the connector portion extends upwards and away from the base end at an acute angle.

In a further embodiment, the device further comprises a guide surface positioned at a bottom of the frame portion and having a leading edge on the collecting side, wherein the guide surface is angled upwardly from the collecting side to the storing side.

In a further embodiment, the guide surface is connected to the bottom of the frame portion by a hinge wherein the guide surface is substantially perpendicular to the opening when playing objects are being collected and the guide surface is substantially parallel to the opening so as to cover the opening when playing objects are being stored.

In a further embodiment, the handle is connected to the handle portion by a quick-connect coupling.

In a further embodiment, the quick-connect coupling comprises an at least one radial protrusion from the handle and an at least one corresponding hole in the connector portion at the connector end for receiving the at least one radial protrusion when the handle is inserted into the handle portion.

In a further embodiment, the quick-connect coupling comprises a screw extending from the connector end towards the handle for connecting the handle portion to the handle.

In a further embodiment, the quick-connect coupling comprises a threaded hole in the connector end facing the handle for receiving a screw extending from the handle.

In a further embodiment, the net is removably attached to the frame portion.

In a further embodiment, the playing objects are hockey pucks.

In a further embodiment, the substantially straight base is between 3 and 12 inches in length.

In a further embodiment, the base portion is shaped to correspond to a heel of a hockey stick.

In a further embodiment, the handle is a hockey stick shaft.

In a further embodiment, the handle is a telescoping handle.

In a further embodiment, the device further comprises a guard for protecting the net where the net is connected to the frame portion.

In a further embodiment, the device further comprises a carrying handle.

In a further embodiment, the carrying handle and the guard are at least in part one element.

In a further embodiment, the carrying handle is attached to the frame portion.

In a further embodiment, the carrying handle is located on the collecting side of the frame portion.

In a further embodiment, the carrying handle is hingedly attached to the frame portion such that the carrying handle can rotate between a carrying state and a collecting state.

In accordance with the present disclosure there is further provided a device for collecting and storing playing objects, the device comprising: a blade portion for detachably connecting to a hockey stick blade, the blade portion comprising a sleeve portion that receives a hockey stick blade, the sleeve portion having a an open end and a closed end; a frame portion comprising a first end and a second end, wherein the first end is adjacent to the closed end of the sleeve portion and the frame portion extends from the first end to the second end, the frame portion comprising: an opening for receiving playing objects; a collecting side; a storing side; and a net attached to the frame portion and extending outwardly from the storing side of the frame portion.

In a further embodiment, the device further comprises a guide surface positioned at a bottom of the frame portion and having a leading edge on the collecting side, wherein the guide surface is angled upwardly from the collecting side to the storing side.

In a further embodiment, the guide surface is connected to the bottom of the frame portion by a hinge wherein the guide surface is substantially perpendicular to the opening when playing objects are being collected and the guide surface is substantially parallel to the opening so as to cover the opening when playing objects are being stored.

In a further embodiment, the net is removably attached to the frame portion.

In a further embodiment, the playing objects are hockey pucks.

In a further embodiment, the substantially straight base is between 3 and 12 inches in length.

In a further embodiment, the device further comprises a guard for protecting the net where the net is connected to the frame portion.

In a further embodiment, the device further comprises a carrying handle.

In a further embodiment, the carrying handle and the guard are at least in part one element.

In a further embodiment, the carrying handle is attached to the frame portion.

In a further embodiment, the carrying handle is located on the collecting side of the frame portion.

In a further embodiment, the carrying handle is hingedly attached to the frame portion such that the carrying handle can rotate between a carrying state and a collecting state.

FIGS. 1-6 will be used to describe the claimed invention. These figures depict at least one possible embodiment of the present invention. However, neither the figures nor the description are intended to limit the scope of the claimed invention. That is, the scope of the invention is defined by the claims.

With reference to FIGS. 1-4, the device 1 for collecting and storing playing objects comprises a handle portion 2 having a base portion 3 and a connector portion 4. The connector portion 4 has a base end 5 adjacent to the base portion 3. The connector portion 4 extends at least partially upwards and ends at a connector end 6. A handle 20 is connectable to the handle portion 2 at the connector end 6.

The frame portion 7 comprises a first end 8 and a second end 9 wherein the first end 8 is adjacent to the base portion 3 and the frame portion 7 extends from the first end 8 to the second end 9. The frame portion 7 may be fixedly attached by way of screws, glue or other securing means to the handle portion 2. Alternatively, the frame portion 7 and handle portion 2 may be integrally connected, or molded or welded together as a single or unitary piece. The frame portion 7 also has an opening 10, a collecting side 11, and a storing side 12.

A net 13 is attached to the frame portion 7 and extends outwardly away from the frame portion 7 on the storing side 12 of the frame portion 7.

When a user intends to collect playing objects using the device 1, a handle 20 may be connected to the handle portion 2 at the connector end 6, and the user can grip, hold or maneuver the handle 20 to collect playing objects, or while playing objects are collected, in the device 1.

The frame portion 7 is configured to allow playing objects to pass through the opening 10 from a collecting side 11 to a storing side 12 and into the net 13. The bottom of the frame portion 7 may contact the ground or playing surface when a user is collecting playing objects. The dimensions of the frame portion 7 may vary depending on the desired application. For example, the height of the frame portion 7 is preferably at least the height of the playing object to or that may be collected, and more preferably at least 1.5 times the height of the playing object to or that may be collected. The length of the frame portion 7 is preferably at least the length of the playing object to or that may be collected, and more preferably is at least two times the length of the playing object to or that may be collected. The thickness of the frame portion 7 will depend on the strength of the material used. The skilled person will recognize that as the length of the frame portion 7 increases, the strength of the frame portion 7 will preferably increase, either through a change in material used or a change in the thickness of the frame portion 7. Similarly, as the weight of the playing objects to be collected and stored increases, the strength of the frame portion 7 will preferably increase, either through a change in material used or a change in the thickness of the frame portion 7. It would be understood that there are a number of sufficiently strong, rigid, sturdy or robust materials that may be used to construct the frame portion 7, such as, but not limited to, any sufficiently strong, rigid, sturdy or robust metal, plastic or composite material (e.g., a fiber-reinforced polymer).

The handle portion 2 provides additional support for the frame portion 7, and may be constructed from the same (or similarly sufficient) material as the frame portion 7. Without the handle portion 2, including base portion 3 and connector portion 4, the device 1 may not be sturdy enough to withstand heavy usage and/or relatively heavier playing objects (such as hockey pucks as opposed to golf balls). In this regard, prior art devices as discussed above that include a handle connected to a frame portion may not be as strong or sturdy as the presently disclosed device with respect to the connection between the handle and frame portion. Moreover, in devices where a frame portion may be self-supporting, strength and structural integrity in this regard may be inferior as compared to the presently disclosed device. Further, such devices may be less convenient than the presently disclosed device, as the presently disclosed device can be maneuvered quickly to different locations, as its frame portion 7 is not self-supporting or intended to remain stationary in one place.

As the handle portion 2 of the present invention provides additional support to the frame portion 7 by way of the base portion 3 and the connector portion 4, those portions bear at least some of the weight of the playing objects that are stored in the net 13, thereby reducing the strain on the frame portion 7.

The handle portion 2 may be configured in a variety of orientations. For example, the connector portion 4 may extend upwards from the base portion 3 in a substantially vertical direction, such that the handle 20 is substantially vertical when connected to the handle portion 2.

Figure 2:
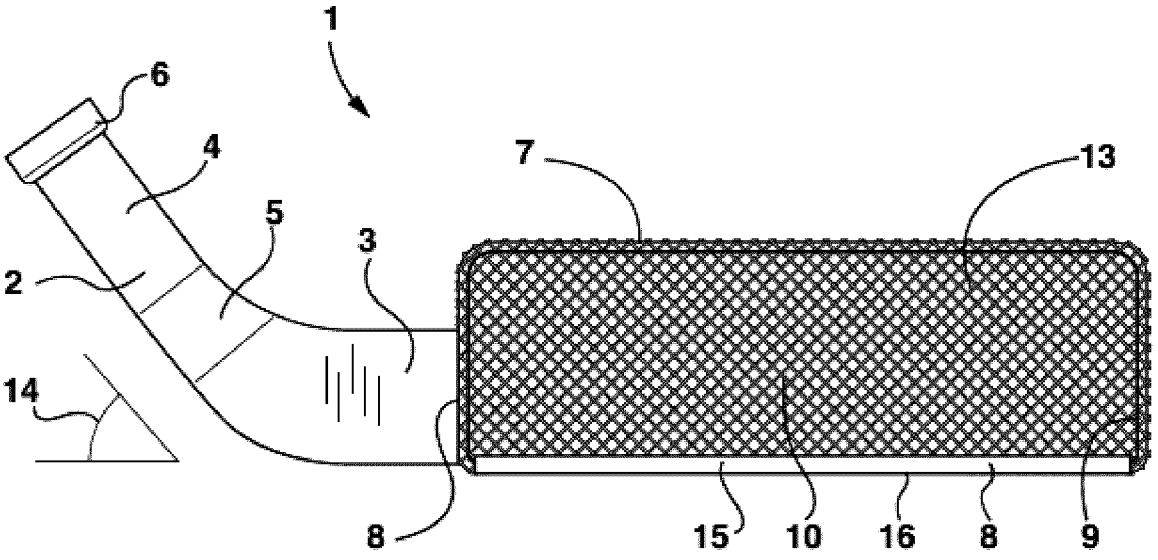
FIG. 2 is a front view of the device in accordance with the present invention.
Figure 3:
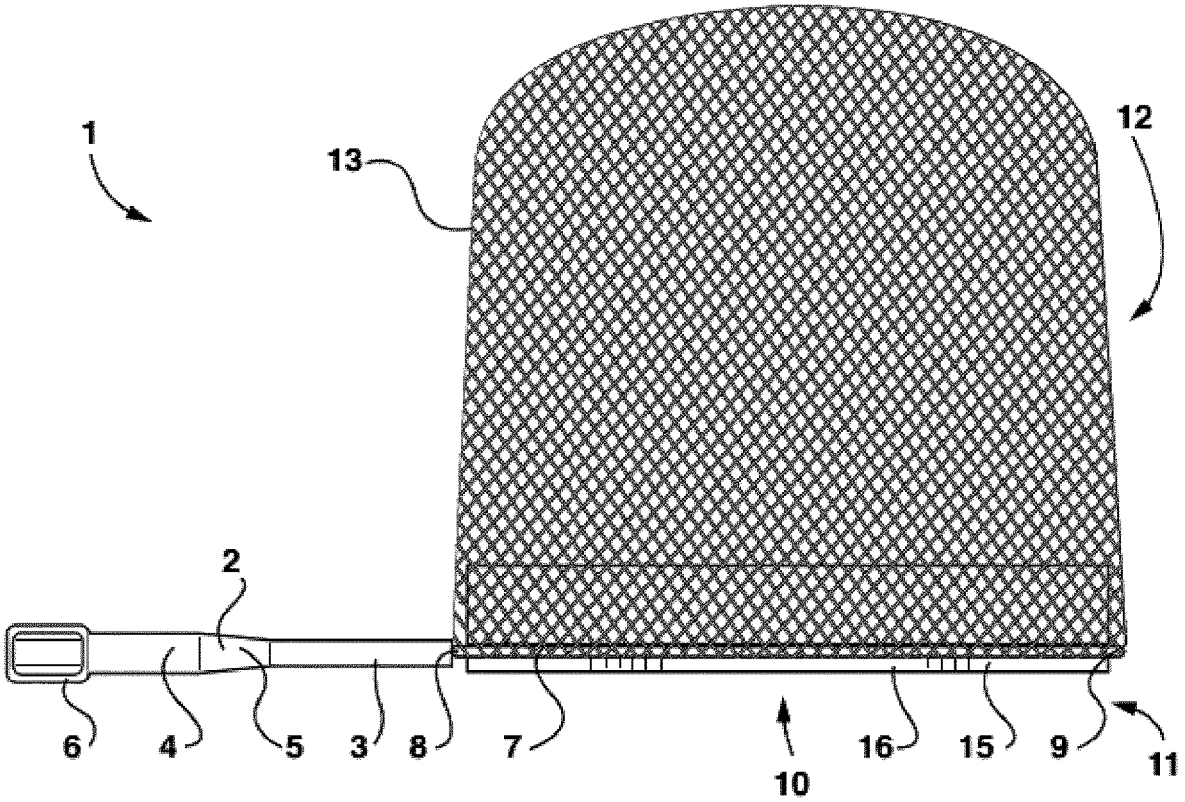
FIG. 3 is a top view of the device in accordance with the present invention.
Figure 4:
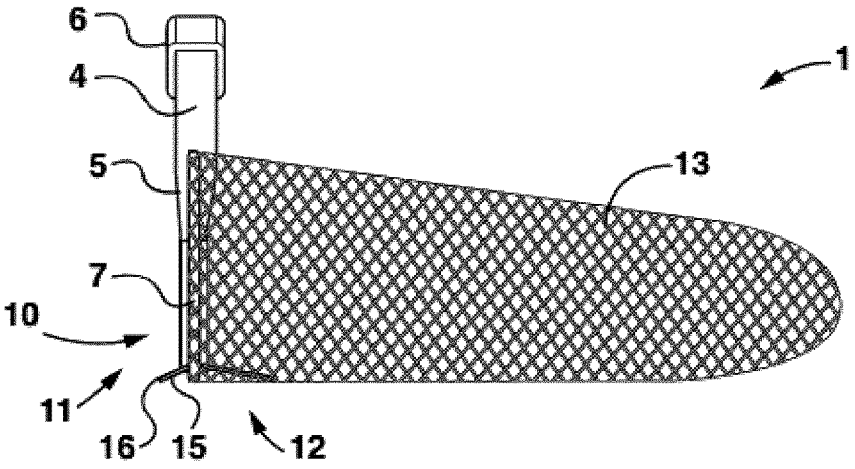
FIG. 4 is a side view of the device in accordance with the present invention.

Alternatively, and as shown in FIGS. 1-4, the connector portion 4 may extend upwards and away from the base portion 3 at an acute angle 14 (shown in FIG. 2). This acute angle 14 may vary depending on the application or the user's preference. Preferably, the connector portion extends at least partially upwards (i.e., at an angle greater than 0 degrees).

As shown in FIGS. 1-4, the acute angle 14 may be similar to the acute angle formed between the axis along the length of the shaft of a hockey stick and the axis along the length of a blade of the hockey stick (e.g., 40°-55°). Moreover, the handle 20 may be a hockey stick shift that does not include a blade, or it may be a handle or stick that is similar in length and/or shape to a hockey stick shaft. Further, the base portion 3 may be shaped to correspond to a heel of a hockey stick. This configuration may allow a user of the device 1 to grip and/or maneuver the handle 20 in a similar manner to how a hockey player grips and/or maneuvers a hockey stick, which provides the user with leverage when collecting playing objects.

The added strength from the handle portion 2 having a base portion 3 and a connector portion 4 may allow a user to exert at least some moderate force on the device 1 when collecting hockey pucks, or other playing objects. For example, the user collecting hockey pucks on an ice surface may skate at speed with the device 1 connected to a handle 20 and push the device 1 towards hockey pucks with the frame portion 7 sliding along the ice. The hockey pucks may then contact the bottom of the frame portion 7 and enter the net 13, while the handle portion 2 and frame portion 7 may maintain their rigidity. Additionally or alternatively, one or more other individuals apart from the user may shoot one or more pucks at or towards the device 1 so that the pucks enter into the net 13. In this situation, the user controlling the device 1 may be stationary with the device 1 to receive the one or more pucks that have been or are being shot, or the user may be moving with the device 1 such as moving towards the one or more pucks that have been or are being shot. In the further alternative, the device 1 may be used as a tool for players to practice their shooting aim, e.g., players may shoot pucks at and into the device 1 from a distance for the purpose of practicing their aim (i.e., target practice) in addition to for the purpose of collecting pucks.

The frame portion 7 may optionally have a guide surface 15 having a leading edge 16. The guide surface 15 may be positioned along the bottom of the frame portion 7 and the leading edge 16 may be at or adjacent to the collecting side 11. The leading edge 16 of the guide surface 15 may contact the ground or playing surface when a user is collecting playing objects. The guide surface 15 may angle upwardly from the collecting side 11 to the storing side 12. The guide surface 15 may reduce the resistance to and may facilitate playing objects entering into the net 13 through the opening 10. In this regard, any structure along the bottom of the frame portion 7 may create some resistance to playing objects entering the net 13. For example, flat hockey pucks sliding into a structure along the bottom of the frame portion 7 may strike such structure and not enter the net 13. In order to decrease or minimize this resistance, the guide surface 15 and leading edge 16 are configured to allow hockey pucks, or other playing objects, to enter the net 13 with less resistance. Preferably, the leading edge 16 of the guide surface 15 is thin and does not present any significant obstruction to a playing object to be entered into the net 13. The guide surface 15, which may be elevated on the storing side 12 relative to the collecting side 11, may also act as a barrier or hindrance to playing objects sliding, rolling or escaping out of the net 13 after they have cleared the guide surface 15 and entered the net 13. Preferably, to minimize the escaping of playing objects but continue to allow other playing objects to enter the net 13, the height of the guide surface 15 at its end on the storing side 12 is as approximately the height of the playing object.

The guide surface 15 including leading edge 16 can either be formed directly into or as part of the frame portion 7 during construction or manufacture, or they may comprise a separate piece or component that is attached to the frame portion 7. The length of the guide surface 15 and leading edge 16 may be substantially the same as the length of the bottom of the frame portion 7. The width of the guide surface 15 may vary depending on the application. Preferably, the width of the guide surface 15 is 2-3 inches.

The guide surface 15 may also be connected to the frame portion 7 by a hinge (not shown) to allow the guide surface 15 to be moveable or rotatable and act as a door. During collection of playing objects, the hinge may allow the guide surface 15 to be positioned substantially perpendicular to the opening 10, or on an acute angle relative to the opening 10, such that playing objects can pass through the frame portion 7 from a collecting side 11 to a storing side 12 along the guide surface 15. During storage, the hinge may allow the guide surface 15 to rotate to a position substantially parallel to or flush with the opening 10 such that entry or exit of playing objects through the opening 10 is substantially or fully blocked by the guide surface 15. The guide surface 15 may be held in place when in either the storage state or the collecting state by a pin, clip or other securing component. Alternatively, the guide surface 15 may be a spring-loaded or otherwise movable door that, during playing object collection, opens by rotating or turning from vertical to horizontal (open door) when a playing object strikes it, and, once the playing object has continued into the net 13 past the guide surface 15, the guide surface 15 may rotate or turn back to the vertical (closed door) position. In the further alternative, the device may provide for a fixed guide surface 15, and additionally provide for a rotating or spring-loaded door as described above. Having such a door that fully closes each time a playing object enters the net improves the collection process, as playing objects may enter but not exit the net.

The net 13 extends from the storing side 12 of the frame portion 7 and is for receiving and storing playing objects. The design of the net 13 may depend on the particular playing objects to be collected and stored. Preferably, the net 13 is flexible. For example, for collecting and storing hockey pucks, the net 13 with holes preferably has holes that are smaller than the diameter of a hockey puck (i.e., smaller than 3 inches or 7.6 cm), and is preferably made of a material that is sufficiently strong to hold a number of hockey pucks. A sufficiently strong rubber, nylon, polyester, polypropylene or other synthetic fiber may be suitable in this regard. The configuration of the material for the net, depending on the material, may be one or more of knotted, woven, web, rope or braided. For collecting and storing golf balls, the holes in the net 13 are preferably significantly smaller (i.e., at most slightly smaller than the diameter of a golf ball, which is approximately 1.68 inches or 4.27 cm). While the material for a net for golf balls may not need to be as strong, the larger the holes, the less flexible the material should be so as to minimize golf balls escaping the net via a hole (by stretching the material, for example). Alternatively, the net 13 may be a bag, basket or other containment component without any holes or significant holes, aside from at the opening 10. Preferably, the net 13 is 1 to 2 feet deep.

A flexible or collapsible net 13 and a removable handle 20 may allow for the device 1 to be easily or conveniently stored during non-use. The handle connector 2 and the frame portion 7 are the only rigid or less flexible components of the device 1 described above. As exemplified by FIGS. 1-4, the handle connector 2 and frame portion 7 are relatively small and each have a thin profile. The net 13 does not add significant size or thickness to the device 1, particularly when collapsed. If the device 1 is used for collecting hockey pucks, the device 1, together with the stored hockey pucks, may be placed within a hockey player's hockey bag with the player's hockey equipment. Alternatively, if the device 1 is used for collecting golf balls, the device 1, together with the stored golf balls, may be placed within a golf player's golf bag. Alternatively, if the device 1 is used for collecting tennis balls, the device 1, together with the stored tennis balls, may be placed within a tennis player's tennis bag.

The net 13 may be removably connected to the frame portion 7, or permanently connected to the frame portion 7. For example, during storage, a removable net 13 may be removed from the frame portion 7 and stored separately from the device 1. Generally, the net 13 may be connected to the frame portion 7 by way of weaving any holes of the net to the frame portion 7, or by way of one or more of the following: clips, strings, grooves, hooks, pins, screws, glue, tape, Velcro, or other securing components.

Figure 5:
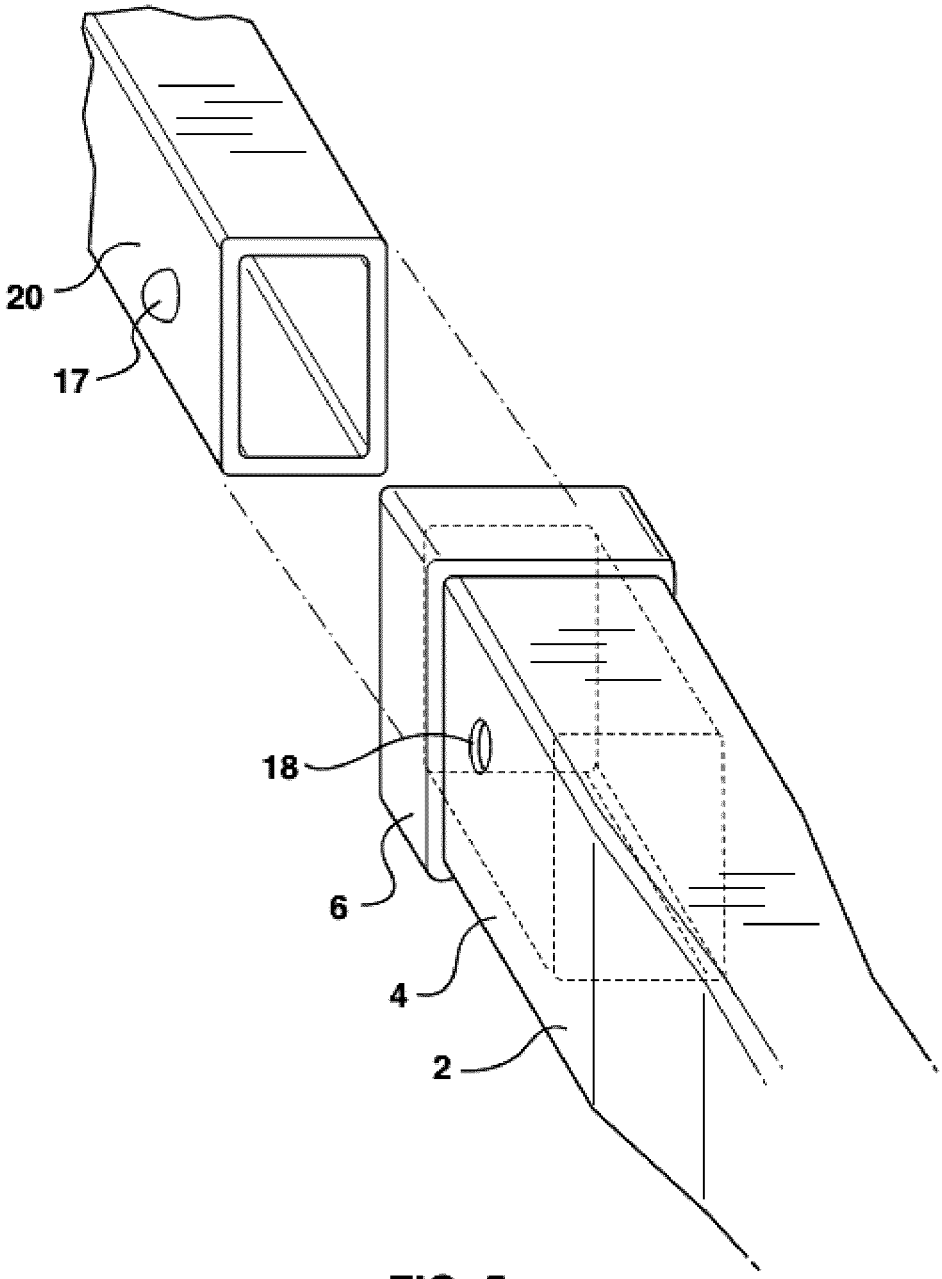
FIG. 5 is a perspective view from the side of a quick-coupling device for connecting the handle to the handle connector in accordance with the present invention.

The coupling or connecting between the handle 20 and handle portion 2 preferably provides for relatively quick connection and quick disconnection. For example, FIG. 5 depicts a quick-connect coupling comprising a radial protrusion 17 on one side of the handle 20 and a corresponding hole 18 in the connector portion 4 at the connector end 6. When the handle 20 is inserted into the connector end 6, the handle 20 is pushed inwards until the radial protrusion 17, which may be depressible or spring-loaded, falls into or enters the corresponding hole 18. Once the radial protrusion 17 protrudes through the corresponding hole 18, the handle 20 is coupled or connected to the handle portion 2, and the device 1 may be used for collecting playing objects. To remove the handle 20, the radial protrusion 17 is pushed towards the interior of the handle 20 such that the radial protrusion 17 is pushed out of the corresponding hole 18 and the handle 20 is then pulled away from the handle portion 2.

FIG. 5 shows an embodiment having only one radial protrusion 17 and corresponding hole 18; however, a plurality of radial protrusions and corresponding holes may be used, which may improve the rigidity of the coupling or connection.

While FIG. 5 depicts one type of coupling contemplated by the inventors, other types of coupling may be used without affecting the working of the invention. Other types of couplings include, but are not limited to, press-fit, longitudinal screw(s), transverse screw(s), transverse pin(s), clamped connector(s), detachable adhesives, friction-based connection, and the like.

The handle may be pre-fitted with the radial protrusion 17, or other type of coupling as described above. Alternatively, an adapter piece that includes the radial protrusion 17, or other type of coupling as described above, may be connected to a handle that otherwise does not include any coupling means or mechanism or otherwise may not be connectable to the device. The adapter piece may include a radial protrusion, or other type of coupling as described above, for joining the handle to the device when the handle is connected to the adapter. Connecting the handle to the adapter may require, as appropriate, one or more of the types of coupling described above. For example, a user may attach the adapter to a hockey stick shaft using one or more screws, and the adapter may be connectable to the device using the radial protrusion 17, or other type of coupling as described above.

The handle 20 may be one of a variety of different types, including re-purposed objects. In one embodiment, the handle 20 is a hockey stick shaft from a hockey stick that does not have a blade. In this embodiment, the connecter end 6 may be designed such that a hockey stick shaft can be inserted into the connector end 6 for connection to the handle portion 2, using a coupling as described above.

In an alternative embodiment, the handle 20 may be a telescoping handle that is removably connected to the handle portion 2. When the device 1 is stored away during non-use, the telescoping handle may be telescoped to a short handle for ease of storage.

In some embodiments, it may be preferable for the handle and the device to be a single, unitary piece that is integrally connected, molded, glued, welded or otherwise permanently joined.

Although not shown, the device may include a carrying handle attached to the frame portion. Preferably, the carrying handle is located on the collecting side of the frame portion. Preferably, the carrying handle may hinge, swivel or rotate from a collection state where the carrying handle is adjacent to or flush with at least a portion of the frame portion, to a carrying or storage state where the handle extends away from the frame portion perpendicular to the opening and on the collecting side. Such a configuration may allow a user to carry the device by hand with the net hanging in a downward direction and including any playing objects in the net (similar to a carrying bag). Preferably, the carrying handle is removably connected to the device.

Although not shown, is the device may also include a guard to protect the net where the net is connected to the frame portion. The guard preferably wraps around, covers or shields the area where the frame portion and net are coupled or connected on at least the collecting side of the frame portion. This guard, which may be made of metal, plastic or other suitably durable material, is intended to protect the net from being damaged when playing objects are being collected.

In a further embodiment, the carrying handle and guard may, at least in part, be one element. In one particular embodiment, the carrying handle may be hingedly connected to the frame portion such that the carrying handle may rest against at least part of the frame portion when the carrying handle is in a collection state. In this state, the carrying handle may act as a guard to protect or shield the net where the net is connected to the frame portion. To move the carrying handle to a carrying or storage state, the carrying handle may be rotated about its connection point(s) on the frame portion and thereby extend away from the frame portion.

The limited number of members, components and materials, and the simplicity of the design of the present invention may allow for low-cost and efficient manufacturing and assembly, particularly when compared to existing devices for collecting playing objects.

Figure 6:
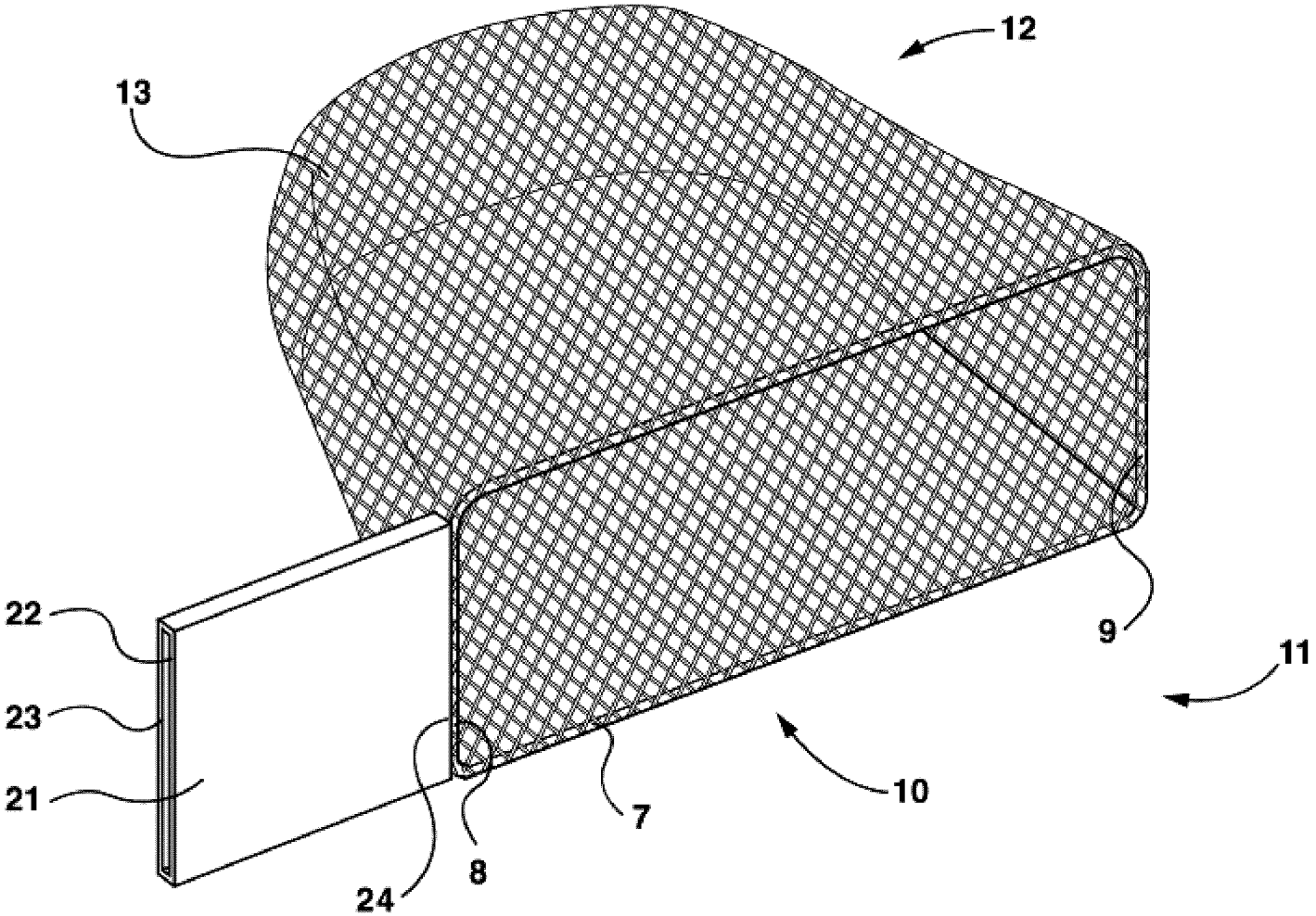
FIG. 6 is a perspective view from the side of a device in accordance with the present invention that is detachably connected to a hockey stick blade.

In another embodiment shown in FIG. 6, the device is designed to be detachably connected or coupled to a hockey stick blade. In this embodiment, the device comprises a blade portion 21, a frame portion 7, and a net 13. The blade portion 21 has a sleeve portion 22 with an open end 23 and a closed end 24. The open end 23 is designed to receive a hockey stick blade. The frame portion 7 has a first end 8 and a second end 9, wherein the first end 8 is adjacent to the closed end 24 of the sleeve portion 22 and the frame portion 7 extends from the first end 8 to the second end 9. The frame portion 7 further comprises an opening 10, a collecting side 11, and a storing side 12. The net 13 is attached to the frame portion 7 and extends outwardly from the frame portion 7 on the storing side 12.

Preferably, the sleeve portion is shaped and sized so as to receive a significant portion of the blade of a hockey stick (i.e., preferably at least 25% of the length of a typical hockey stick blade), and to maintain a secure connection of coupling between the stick and the device. The longer the sleeve portion, the more curvature the sleeve portion may require so as to accommodate a typical hockey stick blade. In order to further improve the secureness of the connection, the sleeve portion may include one or more securing components, such as a flexible material (e.g., a foam or other bendable/flexible component having a slit or opening for inserting the blade) in the sleeve portion that at least partially holds the blade securely in the device. Alternatively, the sleeve portion may be more precisely shaped so as to match, in some instances, a left-handed blade, and, in other instances, a right-handed blade. In the further alternative, the sleeve portion and the hockey stick blade may be connected to one another by way of press fit, clamped connector(s), detachable adhesives, and the like. In the further alternative, the sleeve portion and the hockey stick blade may be connected to one another by way of a one or more of the other means for coupling as described herein. Although in this embodiment there is no base portion, the coupling of the blade and the sleeve portion may act as a substitute with respect to structural support for use of the device. In yet another embodiment, the sleeve portion is made of a stiff material that is capable of some deformation, such that the sleeve can be deformed to fit blades of different curvatures, with the further option of fitting both left-handed and right-handed blades of different or opposite curvatures. As the skilled person will appreciate, however, the material of the sleeve must be stiff enough to support the remainder of the device extending from the sleeve and the playing objects during collection.

This embodiment allows a user to operate the device with an existing or intact hockey stick that includes a blade. For example, a hockey player may attach the device to the same hockey stick he/she uses for hockey practice, and then proceed to collect pucks. Once collected, the device can be removed from the hockey stick and stored. The hockey player can then continue to use the hockey stick during continued play or practice.

This embodiment can also be varied as discussed herein. That is, the device may include a guide surface and a leading edge, a carrying handle, a guard to protect the net where the net is connected to the frame portion, and/or a removable net.

It will be appreciated by those skilled in the art that the device may be manufactured so as to be connectable to a handle for use by a right-handed user (i.e., the handle portion is located to the left of the frame portion when looking at the frame portion from the storing side to the collecting side), or, alternatively, connectable to the handle for use by a left-handed user (i.e., the handle portion is located to the right of the frame portion when looking at the frame portion from the storing side to the collecting side).

While at least one exemplary embodiment has been presented in the foregoing detailed description, it should be appreciated that variations may exist. It should also be appreciated that the exemplary embodiment or exemplary embodiments are only examples, and are not intended to limit the scope, applicability or configuration of the disclosure in any way. Rather, the foregoing detailed description will enable those skilled in the art to implement an exemplary embodiment of the disclosure, it being understood that various changes may be made in the function and arrangement of elements described in an exemplary embodiment without departing from the scope of the invention as set forth in the appended claims. That is, the scope of the appended claims should not be limited by the preferred embodiment set forth in the examples, but should be given the broadest interpretation consistent with the description as a whole.

What is claimed is:

1. A device for collecting and storing playing objects, the device comprising:

a handle portion for detachably connecting to a handle, the handle portion comprising:
- a base portion; and
- a connector portion, the connector portion comprising a base end and a connector end, wherein:
  - the base end is adjacent to the base portion;
  - the connector portion extends at least partially upwards and ends at the connector end; and
  - the handle is connectable to the handle portion at the connector end;

a frame portion comprising a first end and a second end, wherein the first end is adjacent to the base portion and the frame portion extends from the first end to the second end, the frame portion further comprising:
- an opening for receiving playing objects;
- a collecting side; and
- a storing side;

a net attached to the frame portion and extending outwardly from the storing side of the frame portion; and a guide surface positioned at a bottom of the frame portion and having a leading edge on the collecting side, wherein the leading edge is angled upwardly from the collecting side to the storing side, wherein the guide surface has a width of 2-3 inches and extends past the storing side of the frame portion when playing objects are being collected and is elevated on the storing side relative to the collecting side at a height that is approximately the height of a playing object of the playing objects being collected, and wherein the leading edge at least partially contacts a playing surface when playing objects are being collected and the opening of the frame portion is perpendicular to the playing surface.

2. The device of claim 1, wherein the connector portion extends upwards and away from the base end at an acute angle.

3. The device of claim 1, wherein the guide surface is connected to the bottom of the frame portion by a hinge, wherein the guide surface is perpendicular or on an acute angle relative to the opening when playing objects are being collected and the guide surface is parallel to or flush with the opening so as to at least partially cover the opening when playing objects are being stored.

4. The device of claim 3, wherein the guide surface is spring-loaded and is biased to be parallel to or flush with the opening, and is configured to be rotated to be perpendicular or on an acute angle relative to the opening when a playing object strikes the guide surface when playing objects are being collected.

5. The device of claim 1, wherein the handle is connected to the handle portion by a quick-connect coupling.

6. The device of claim 5, wherein the quick-connect coupling comprises an at least one radial protrusion from the handle and an at least one corresponding hole in the connector portion at the connector end for receiving the at least one radial protrusion when the handle is inserted into the handle portion.

7. The device of claim 5, wherein the quick-connect coupling comprises a screw extending from the connector end towards the handle for connecting the handle portion to the handle.

8. The device of claim 5, wherein the quick-connect coupling comprises a threaded hole in the connector end facing the handle for receiving a screw extending from the handle.

9. The device of claim 1, wherein the base portion is shaped to correspond to a heel of a hockey stick.

10. The device of claim 1, further comprising a guard for protecting the net where the net is connected to the frame portion.

11. The device of claim 1, further comprising a carrying handle.

12. The device of claim 11, wherein the carrying handle is hingedly attached to the frame portion such that the carrying handle can rotate between a carrying state and a collecting state.

13. The device of claim 1, wherein the first end of the frame portion is fixedly attached to the base end of the handle portion.

14. The device of claim 1, wherein the handle portion is integrally connected with the frame portion.

15. The device of claim 1, wherein the guide surface has a length that runs between half of a length of the frame portion and a full length of the frame portion.

* * * * *